US009364034B2

(12) United States Patent
Best

(10) Patent No.: US 9,364,034 B2
(45) Date of Patent: Jun. 14, 2016

(54) PROTECTIVE TROUSERS WITH CURVED EXTREMITY AND INSEAM

(75) Inventor: Diane Best, Beattyville, KY (US)

(73) Assignee: LION GROUP, INC., Dayton, OH (US)

( * ) Notice: Subject to any disclaimer, the term of this patent is extended or adjusted under 35 U.S.C. 154(b) by 224 days.

(21) Appl. No.: 13/984,544

(22) PCT Filed: Feb. 7, 2012

(86) PCT No.: PCT/US2012/024044

§ 371 (c)(1),
(2), (4) Date: Oct. 22, 2013

(87) PCT Pub. No.: WO2012/109172

PCT Pub. Date: Aug. 16, 2012

(65) Prior Publication Data

US 2014/0033393 A1 Feb. 6, 2014

Related U.S. Application Data

(60) Provisional application No. 61/441,102, filed on Feb. 9, 2011.

(51) Int. Cl.

| | |
|---|---|
| ***A41D 13/05*** | (2006.01) |
| ***A41D 13/00*** | (2006.01) |
| ***A62B 17/00*** | (2006.01) |
| ***A41D 13/06*** | (2006.01) |

(52) U.S. Cl.

CPC ..... *A41D 13/0543* (2013.01); *A41D 13/0005* (2013.01); *A41D 13/0587* (2013.01); *A41D 13/065* (2013.01); *A62B 17/003* (2013.01)

(58) Field of Classification Search

CPC . A41D 13/0002; A62B 17/003; A62B 17/001
See application file for complete search history.

(56) References Cited

U.S. PATENT DOCUMENTS

| | | | |
|---|---|---|---|
| 331,959 | A | 12/1885 | Goldsmith |
| 1,082,213 | A | 12/1913 | Robinson |
| 1,827,585 | A | 10/1931 | Kautz |
| 2,127,355 | A | 8/1938 | Grundstrom |
| 3,534,406 | A | 10/1970 | Barthlome |
| 3,819,638 | A | 6/1974 | Kiyoshi et al. |
| 4,091,464 | A | 5/1978 | Vykukal |
| 4,091,465 | A | 5/1978 | Webbon et al. |
| 4,146,933 | A | 4/1979 | Jenkins et al. |
| 4,509,213 | A | 4/1985 | Harvey |

(Continued)

FOREIGN PATENT DOCUMENTS

| | | |
|---|---|---|
| DE | 20 2009 010 569 U1 | 9/2009 |
| JP | 8-337905 | 12/1996 |

OTHER PUBLICATIONS

PCT, International Search Report and Written Opinion, PCT/US2012/024044 (mailed May 23, 2012).

(Continued)

*Primary Examiner* — Anna Kinsaul
(74) *Attorney, Agent, or Firm* — Thompson Hine LLP

(57) ABSTRACT

Disclosed is a protective garment that includes a lower portion having a pair of extremities each having a knee joint area connected to an upper leg portion by an upper radial seam and connected to a lower leg portion by a lower radial seam. The knee joint area of each extremity also has an inseam insert connected between the upper and lower radial seams.

17 Claims, 12 Drawing Sheets

(56) References Cited

U.S. PATENT DOCUMENTS

| | | | | | |
|---|---|---|---|---|---|
| 4,543,670 | A | | 10/1985 | Ehring | |
| 4,599,075 | A | | 7/1986 | Nygard | |
| 4,608,716 | A | | 9/1986 | Brumfield | |
| 4,631,753 | A | | 12/1986 | Ehring | |
| 4,722,099 | A | | 2/1988 | Kratz | |
| 4,782,534 | A | | 11/1988 | Grilliot et al. | |
| 4,843,646 | A | | 7/1989 | Grilliot et al. | |
| 4,864,655 | A | | 9/1989 | McKenney et al. | |
| 4,922,552 | A | | 5/1990 | Grilliot et al. | |
| 4,967,421 | A | | 11/1990 | Grilliot et al. | |
| 5,010,591 | A | | 4/1991 | Kalaam | |
| 5,031,242 | A | | 7/1991 | Aldridge et al. | |
| 5,038,408 | A | | 8/1991 | DeBaene | |
| 5,072,454 | A | | 12/1991 | Trahan | |
| 5,125,114 | A | | 6/1992 | Grilliot et al. | |
| 5,159,721 | A | * | 11/1992 | Senser et al. | 2/227 |
| 5,165,110 | A | | 11/1992 | Grilliot et al. | |
| 5,219,367 | A | * | 6/1993 | Fields | 2/227 |
| 5,267,354 | A | | 12/1993 | Grilliot et al. | |
| 5,515,543 | A | | 5/1996 | Gioello | |
| 5,548,843 | A | | 8/1996 | Chase et al. | |
| 5,628,063 | A | | 5/1997 | Reed | |
| 5,729,832 | A | | 3/1998 | Grilliot et al. | |
| 5,896,583 | A | | 4/1999 | Grilliot et al. | |
| 5,940,884 | A | | 8/1999 | Grilliot et al. | |
| 5,943,699 | A | | 8/1999 | Barbeau | |
| 6,049,906 | A | | 4/2000 | Aldridge | |
| 6,167,573 | B1 | | 1/2001 | Lewis | |
| 6,317,889 | B1 | | 11/2001 | Reilly et al. | |
| 6,401,245 | B1 | | 6/2002 | Slautterback | |
| 6,427,252 | B1 | | 8/2002 | Lewis et al. | |
| 6,662,372 | B2 | | 12/2003 | Lewis et al. | |
| 6,662,375 | B2 | | 12/2003 | Lewis | |
| 6,678,895 | B1 | | 1/2004 | Grilliot et al. | |
| 6,687,919 | B2 | | 2/2004 | Dilworth et al. | |
| 6,698,031 | B2 | | 3/2004 | Lewis | |
| 6,817,029 | B2 | * | 11/2004 | Mazzarolo | 2/22 |
| 6,836,904 | B2 | | 1/2005 | Harper | |
| 7,500,274 | B1 | * | 3/2009 | Kallen | 2/227 |
| D598,181 | S | * | 8/2009 | Rowe | D2/743 |
| 7,958,569 | B2 | | 6/2011 | Razzaghi et al. | |
| D641,959 | S | * | 7/2011 | Abrams et al. | D2/742 |
| D668,433 | S | * | 10/2012 | Boyle | D2/742 |
| 8,332,963 | B2 | | 12/2012 | Razzaghi et al. | |
| D696,487 | S | * | 12/2013 | Kurmanow | D2/742 |
| 2005/0229292 | A1 | | 10/2005 | Watkins et al. | |
| 2006/0277651 | A1 | | 12/2006 | Razzaghi et al. | |
| 2009/0144873 | A1 | | 6/2009 | Jewell et al. | |

OTHER PUBLICATIONS

English translation of JP 8-337905 (Dec. 1996).

Fire-Dex Brochure, "Protection for the Heat of the Battle" (date unknown; alleged to be "at least since 2003").

Photographs of Fire-Dex garment including pleats at the knees (date of garments unknown; alleged to have been sold "at least since 2003").

EP, Search Report, European Application No. 12744735.7 (Jan. 15, 2015).

* cited by examiner

PROTECTIVE TROUSERS WITH CURVED EXTREMITY AND INSEAM

RELATED APPLICATIONS

This application claims the benefit of U.S. Provisional Application No. 61/441,102, filed Feb. 9, 2011.

TECHNICAL FIELD

This application relates to trousers, and more particularly, to protective trousers having curved and/or protected extremities, such as sleeves, and a radial inseam.

BACKGROUND

Protective or hazardous duty garments are used in a variety of industries and settings to protect the wearer from hazardous conditions such as heat, smoke, cold, sharp objects, chemicals, liquids, fumes and the like. Such protective or hazardous duty garments are often used in adverse conditions, such as high heat, exposure to smoke or chemicals and the like. In addition, the wearers of such garments are typically placed under physical strain by carrying heavy gear and equipment. Wearers seek to avoid fatigue to remain mentally sharp and physically ready to carry out tasks.

Protective garments are often constructed from sturdy and stiff materials to provide sufficient protection. However, the stiffness of these materials may prevent the garment from freely moving and flexing. In particular, many existing protective garments require a wearer to somewhat strain against the garment when the user desires to bend the garment (e.g., when the wearer bends an arm or leg).

In addition, protective garments are typically subjected to wear and tear that may reduce the useful life of the garments. Particularly, the joint area of a garment, such as the knee, elbow and shoulder regions of the garment may experience relatively high abrasions and loads. In addition, certain areas (such as the joints) of the garment can be compressed, such as when a wearer crawls on his or her knees, rests on his or her elbows, or carries a load on his or her shoulders. When the garment is compressed in this manner the heat protection of the garment may be reduced. Thus, locating protective pads on the knee, elbow and shoulder areas may provide additional heat protection to the wearer and the garment. Existing protective pads may be made of relatively stiff material. The stiff material may restrict movement of the wearer, in particular the wearer's ability to bend his or her joints, such as the knees, elbows or shoulders, where the pads are located. Additionally, protective pads and the stiff material may contribute to the pads becoming misaligned with the knee of the wearer, for example, when the wearer bends their knee and hence bends the leg of the garment.

SUMMARY

In one aspect, protective garments are disclosed that include a lower portion having a pair of extremities each having a knee joint area connected to an upper leg portion by an upper radial seam and connected to a lower leg portion by a lower radial seam. The knee joint area of each extremity also has an inseam insert connected between the upper and lower radial seams.

In another aspect, methods of assembling the protective garments are disclosed. The protective garments include at least one generally tubular extremity. The methods include providing an upper leg portion and a lower leg portion, a first piece of material, and an inseam insert. To assemble these pieces, a seam is formed in the first piece of material such that the seam imparts a permanent curvature to the first piece of material. Then, the inseam insert is coupled to the first piece of material to form a first knee joint assembly which is then coupled between the upper leg portion and the lower leg portion.

DETAILED DESCRIPTION

Figure 1:
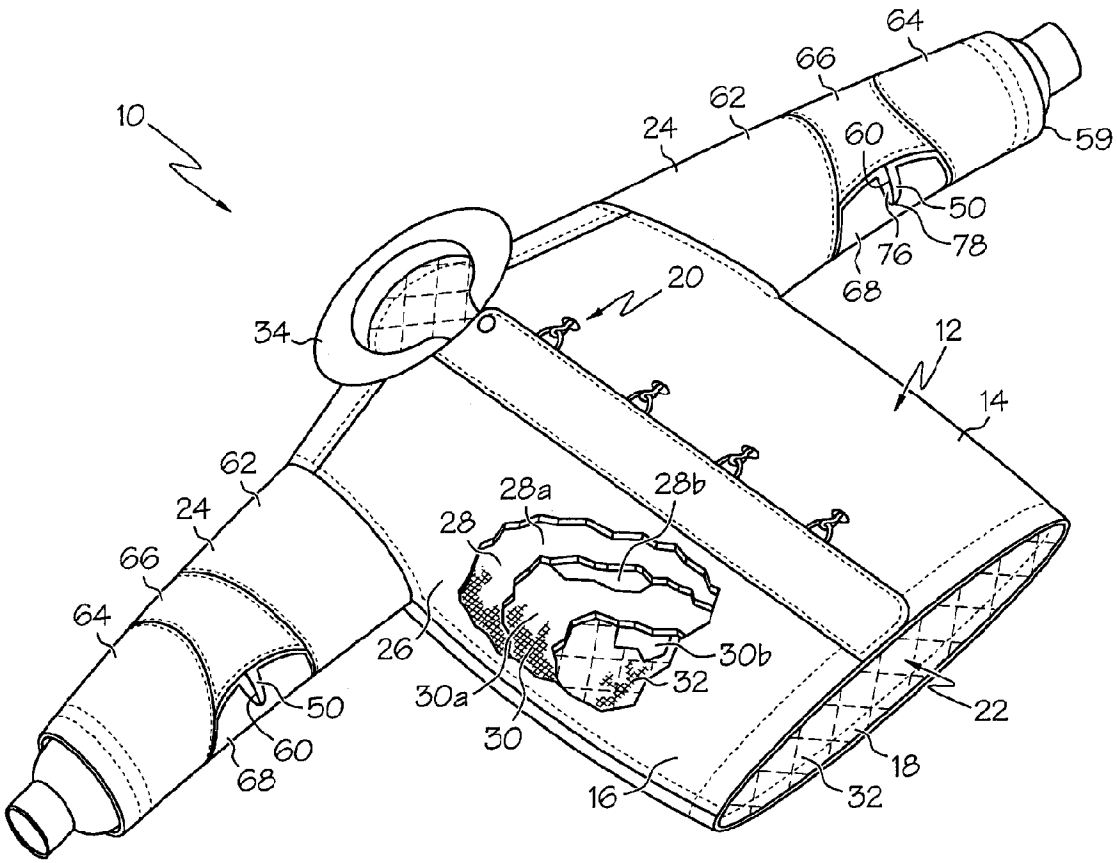
FIG. 1 is a front view of a protective garment in the form of a coat according to one embodiment of the present invention.

The following detailed description will illustrate the general principles of the invention, examples of which are additionally illustrated in the accompanying drawings. In the drawings, like reference numbers indicate identical or functionally similar elements.

Figure 10:
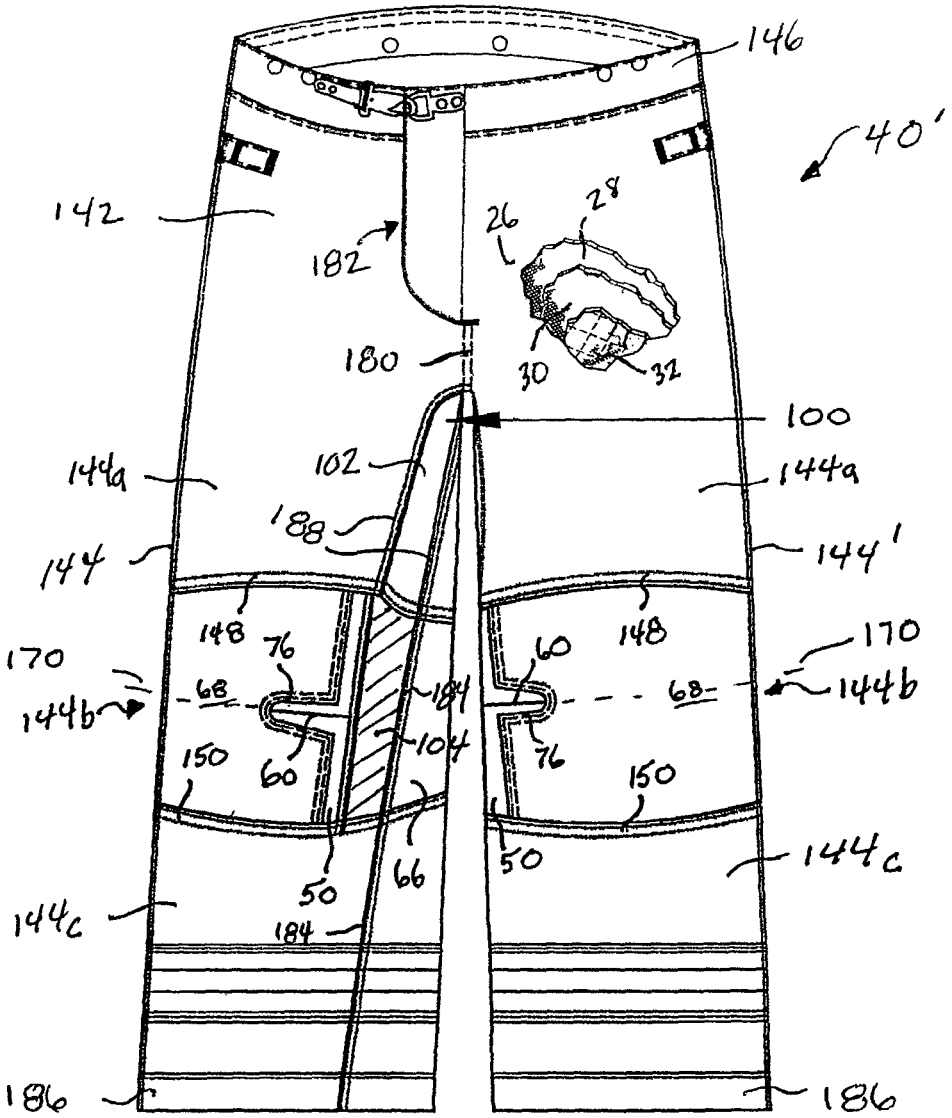
FIG. 10 is a front view of one embodiment of trousers having the right leg shown as a side view to reveal the inseam and the right leg shown from a front perspective view.

FIG. 1 illustrates a protective or hazardous duty garment in the form of a firefighter's coat, generally designated 10, and FIG. 10 illustrates a protective or hazardous duty garment in the form of firefighter's trousers, generally designated 40'.

Turning now to FIG. 1, the coat 10 may include a body portion 12 having a left front panel 14, right front panel 16 and a back panel 18. The left front panel 14 and right front panel 16 may be releasably attachable by a fastener 20, such as a zipper, snaps, clasps, clips, hook-and-loop fastening material (i.e., VELCRO®) or the like. The body portion 12 may define a torso cavity 22 that is shaped to receive a wearer's torso therein. The coat 10 may include a pair of sleeves 24 coupled to and extending generally outwardly from the body portion 12 and may be shaped to receive a wearer's arms therein and cover at least about 90% of the arms of an average sized adult wearer.

The coat 10 may include various layers through its thickness to provide various heat, moisture and abrasion resistant qualities to the coat 10 so that the coat 10 can be used as a protective, hazardous duty, or firefighter garment. For example, the coat 10 may include an outer shell 26, a moisture barrier 28 located inside of and adjacent to the outer shell 26, a thermal liner or barrier 30 located inside of and adjacent to the moisture barrier 28, and an inner liner or face cloth 32 located inside of and adjacent to the thermal liner 30.

The outer shell 26 may be made of or include a variety of materials, including a flame, heat and abrasion resistant material such as a compact weave of aramid fibers and/or polybenzamidazole fibers. Commercially available aramid materials include NOMEX and KEVLAR fibers (both trademarks of E.I. DuPont de Nemours and Company, Inc. of Wilmington, Del.), and commercially available polybenzamidazole fibers include PBI fibers (a trademark of PBI Performance Fabrics of Charlotte, N.C.). Thus, the outer shell 26 may be an aramid material, a blend of aramid materials, a polybenzamidazole material, a blend of aramid and polybenzamidazole materials, or other appropriate materials. If desired, the outer shell 26 may have portions thereof coated with a polymer or coated with a durable, water repellent finish (i.e. a perfluorohydrocarbon finish, such as TEFLON® finish sold by E. I. Du Pont de Nemours and Company, Inc. of Wilimington, Del.). In one embodiment, the portions of the outer shell 26 that are coated are high abrasion areas. The materials of the outer shell 26 may have a weight of, for example, between about 6-10 oz/yd$^2$.

The moisture barrier 28 and thermal liner 30 may be generally coextensive with the outer shell 26, or spaced slightly inwardly from the outer edges of the outer shell 26 (i.e., spaced slightly inwardly from the outer ends of the sleeves 24, the collar 34 and from the lower edge of the coat 10) to provide moisture and thermal protection throughout the coat 10. The moisture barrier 28 may include a semi-permeable membrane layer 28*a* and a substrate 28*b*. The membrane layer 28*a* may be generally moisture vapor permeable but generally impermeable to liquid moisture.

The membrane layer 28*a* may be made of or include expanded polytetrafluoroethylene ("PTFE") such as GORE-TEX or CROSSTECH materials (both of which are trademarks of W.L. Gore & Associates, Inc. of Newark, Del.), polyurethane-based materials, neoprene-based materials, cross-linked polymers, polyamide, or other materials. The membrane layer 28*a* may have microscopic openings that permit moisture vapor (such as water vapor) to pass therethrough, but block liquids (such as water) from passing therethrough. The membrane layer 28*a* may be made of a microporous material that is either hydrophilic, hydrophobic, or somewhere in between. The membrane layer 28*a* may also be monolithic and may allow moisture vapor transmission therethrough by molecular diffusion. The membrane layer 28*a* may also be a combination of microporous and monolithic materials (known as a bicomponent moisture barrier), in which the microporous or monolithic materials are layered or intertwined.

The membrane layer 28*a* may be bonded or adhered to a substrate 28*b* of a flame and heat resistant material to provide structure and protection to the membrane layer 28*a*. The substrate 28*b* may be or include aramid fibers similar to the aramid fibers of the outer shell 26, but may be thinner and lighter in weight. The substrate 28*b* may be woven, non-woven, spunlace or other materials. In the illustrated embodiment, the membrane layer 28*a* is located between the outer shell 26 and the substrate 28*b*. However, the orientation of the moisture barrier 28 may be reversed such that the substrate 28*b* is located between the outer shell 26 and the membrane layer 28*a*.

The thermal liner 30 may be made of any suitable material that provides sufficient thermal insulation. In one embodiment, the thermal liner 30 may include a relatively thick (i.e. between about 1/16"-3/16") batting, felt or needled non-woven material 30*a* which can include aramid fiber batting (such as NOMEX batting), aramid needlepunch material, an aramid non-woven material, an aramid blend needlepunch material, an aramid blend batting material, an aramid blend non-woven material, or foam (either open cell or closed cell) materials. The batting 30*a* may trap air and possess sufficient loft to provide thermal resistance to the coat 10.

The batting 30*a* is typically quilted to a thermal liner face cloth 30*b* which can be a weave of a lightweight aramid material. Thus, either the batting 30*a* alone, or the batting 30*a* in combination with the thermal liner face cloth 30*b*, may be considered to constitute the thermal liner 30. In one embodiment, the thermal liner 30 may have a thermal protection performance ("TPP") of at least about twenty, or of at least about thirty-five. If desired, the thermal liner 30 may be treated with a water-resistant or water-repellent finish. In the illustrated embodiment, the batting 30*a* is located between the outer shell 26 and the thermal liner face cloth 30*b*. However, the orientation of the thermal liner 30 may be reversed such that the thermal liner face cloth 30*b* is located between the outer shell 26 and the batting 30*a*.

Although the moisture barrier 28 is shown as being located between the outer shell 26 and the thermal liner 30, the positions of the moisture barrier 28 and thermal liner 30 may be reversed such that the thermal liner 30 is located between the outer shell 26 and the moisture barrier 28.

The face cloth 32 may be the innermost layer of the coat 10, located inside the thermal liner 30. The face cloth 32 can provide a comfortable surface for the wearer and protect the thermal liner 30 and/or moisture barrier 28 from abrasion and wear.

Each layer of the coat 10, and the coat 10 as a whole, may meet the National Fire Protection Association ("N.F.P.A.") 1971 standards for protective firefighting garments ("Protective Clothing for Structural Firefighting"), which are entirely incorporated by reference herein. The NFPA standards specify various minimum requirements for heat and flame resistance and tear strength. For example, in order to meet the NFPA standards, the outer shell 26, moisture barrier 28 and thermal liner 30 must be able to resist igniting, burning, melting, dripping and/or separation at a temperature of 500° F. for at least five minutes. Furthermore, in order to meet the NFPA standards, all combined layers of the coat 10 must provide a thermal protective performance rating of at least thirty-five.

Figure 2:
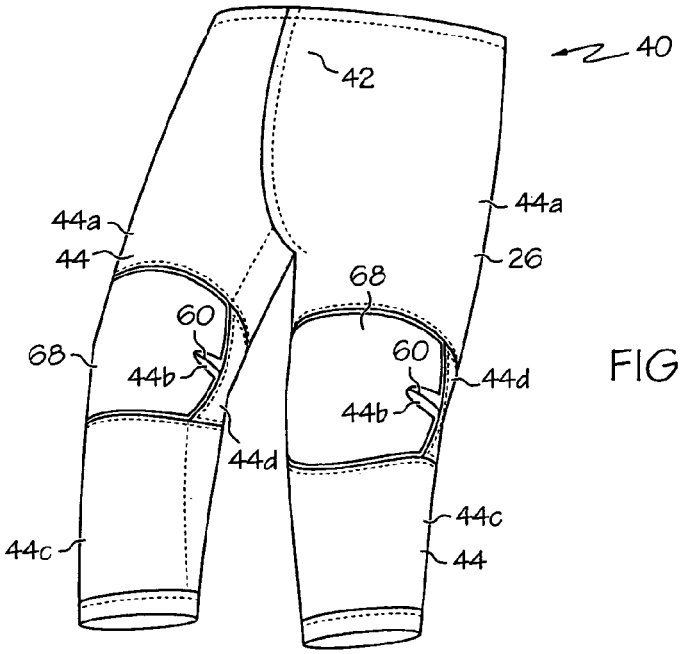
FIG. 2 is a front perspective view of a protective garment in the form of a pair of trousers.
Figure 6:
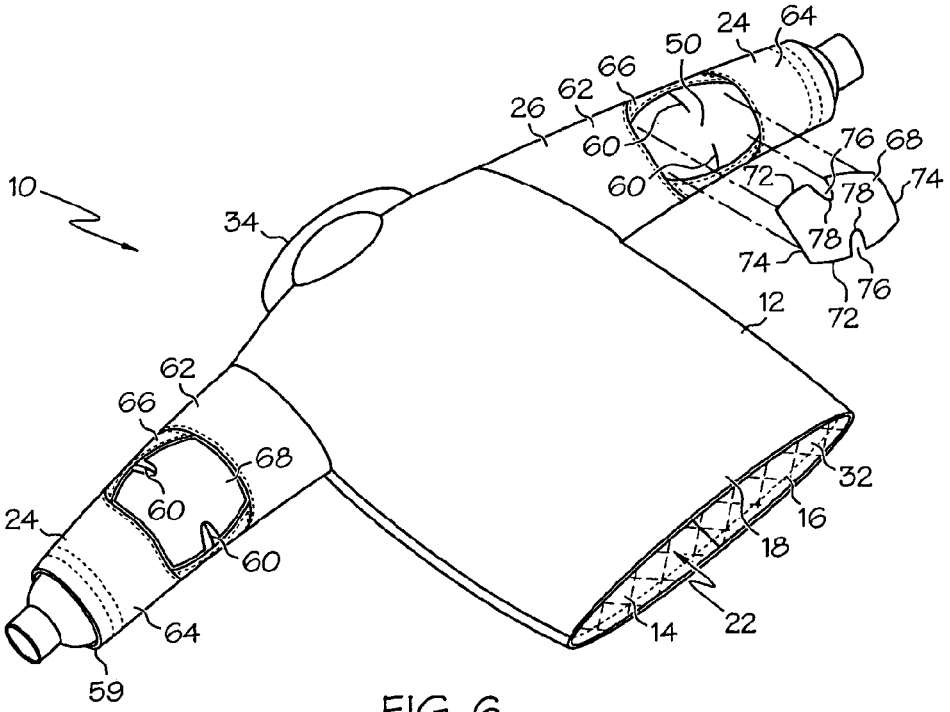
FIG. 6 is a rear perspective view of the garment of FIG. 1, with one of the elbow pads exploded away from the associated sleeve.

As shown in FIG. 2, the protective or hazardous duty garment may take the form of a pair of trousers 40. The trousers 40 may have the same construction including the outer shell 26, moisture barrier 28, thermal liner 30 and face cloth 32 as described above and illustrated for the coat 10. The trousers 40 may include a body portion or torso portion 42 that is shaped and configured to receive the pelvis or lower portion of a wearer's torso therein. The trousers 40 may include a pair of legs 44 coupled to and extending generally outwardly or downwardly from the body portion 42 and may be shaped and configured to receive a wearer's legs therein and cover at least about 90% of the legs of an average sized adult wearer. In addition, the garment of the present invention may include or take the form of vests, jumpsuits, full-body jumpsuits including a coat and trousers combined into a single garment, and the like.

Figure 3:
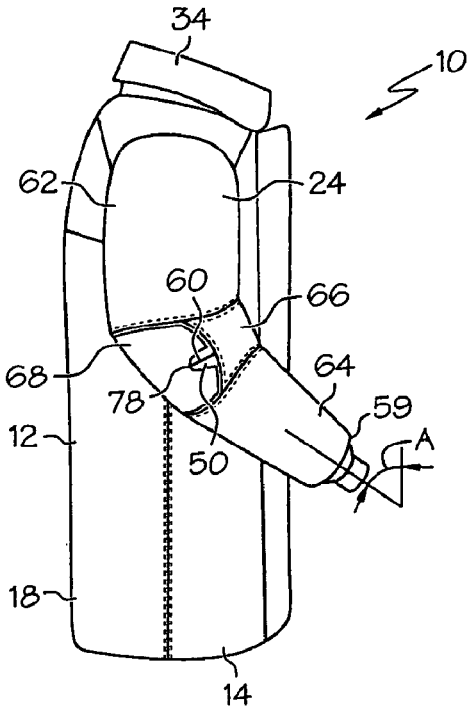
FIG. 3 is a side view of the garment of FIG. 1 in a vertical position.
Figure 4:
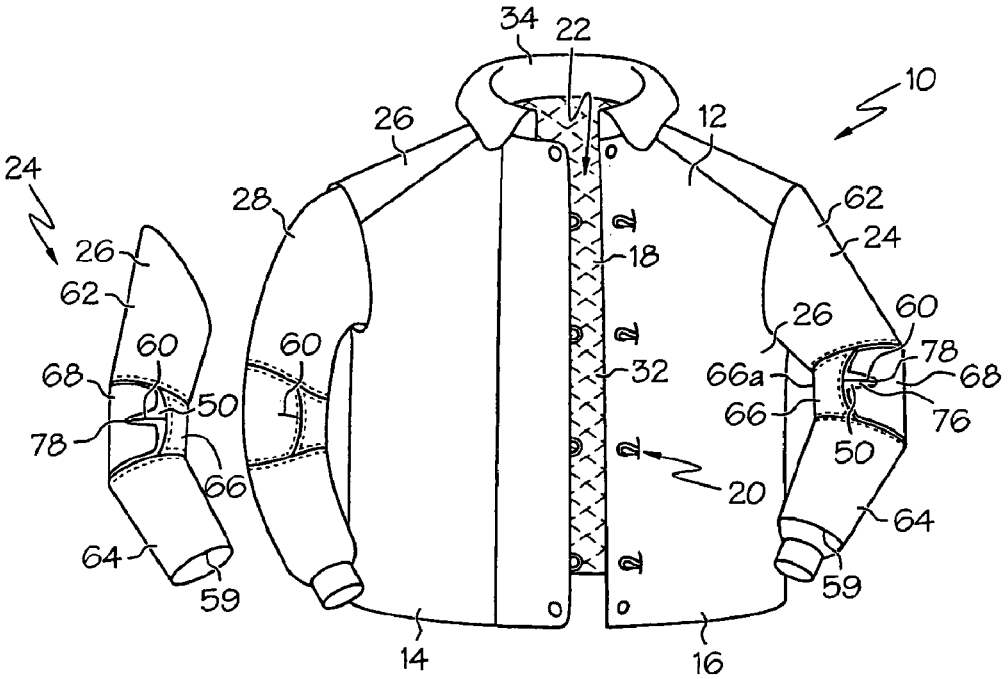
FIG. 4 is a front view of the garment of FIG. 1, with one of the sleeves of the outer shell exploded away from the body of the garment.
Figure 5A:
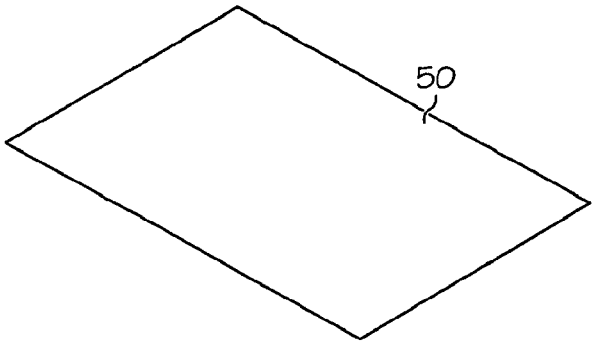
FIGS. 5A-5H are a series of front views showing steps for making a sleeve of the garment of FIG. 1.
Figure 5B:
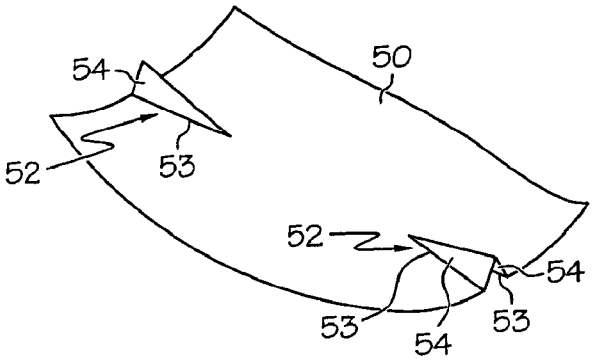

As best shown in FIGS. 2-4, each sleeve 24 and/or leg 44 may have a natural curvature or bend. As shown in FIGS. 5A-5F, a seam may be utilized to provide the desired curvature to the sleeves 24 and/or legs 44. The seam can be formed by providing a generally rectangular piece of material 50, as shown in FIG. 5A. For example, when forming sleeves 24 for the outer shell, the piece of material 50 is made of the same material as the outer shell 26. Next, a pair of generally triangular-shaped folds 52 are formed in the piece of material 50, as shown in FIG. 5B. Each triangular-shaped fold 52 extends up from a fold line 53 and generally inwardly, and in the configuration shown in FIG. 5B extends generally perpendicular to the plane of the piece of material 50. The folds 52 are formed by bringing two portions 54 of the piece of material 50 together until the portions 54 face each other or are overlapping. In the illustrated embodiment, the triangular-shaped folds 52 are aligned, and each is formed at about the midpoint of the short side of the piece of material 50.

Figure 5C:
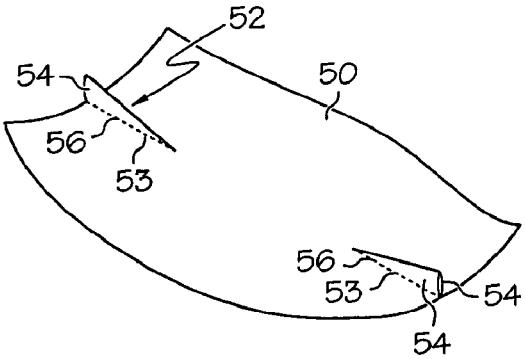
Figure 5D:
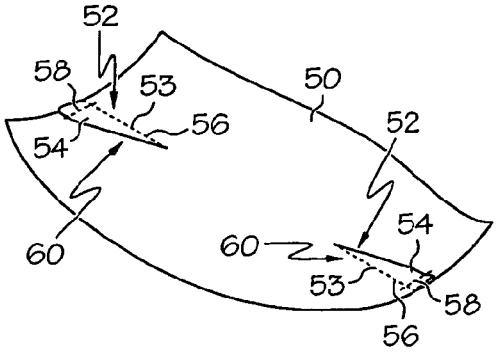

Next, as shown in FIG. 5C, stitching 56 is applied along the bottom length of each triangular-shaped fold 52 (i.e., along the fold lines 53) to secure the two portions 54 of each fold 52 together. Next, as shown in FIG. 5D, each triangular-shaped fold 52 is laid flat against the piece of material 50. Stitching 58 is then applied along the outer edge of each triangular-shaped fold 52 to secure each triangular-shaped fold 52 (which can also be termed remainder material 52) flat against the piece of material 50 to form a dart seam 60. In the illustrated embodiment the two triangular-shaped folds 52 are folded in different directions, although if desired the folds 52 can be folded in the same direction.

The dart seam 60 is located generally internally to the piece of material 50, and generally does not extend along an outer perimeter thereof. In addition, in the illustrated embodiment the dart seam 60 only joins portions of the piece of material 50 to itself, and does not join the piece of material 50 to any other sleeve sections/pieces of material.

Figure 5E:
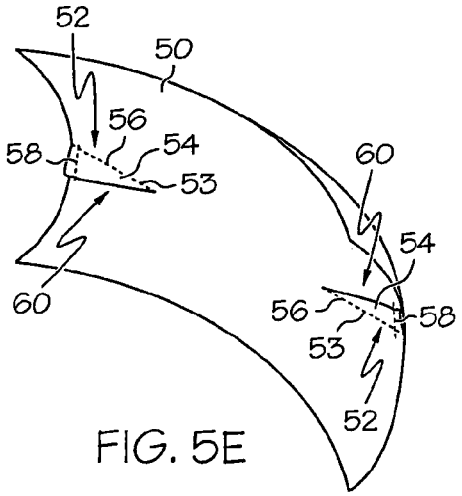

Due to the presence of the dart seams 60, the height of the piece of material 50 is less than its width, which induces a curvature in the piece of material 50. For example, as shown in FIGS. 5D and 5E the natural curvature of the piece of material 50 (which can also be termed an outer sleeve section 50) can be seen. A vertical cross section of the outer sleeve section 50 of FIG. 5E would show a profile that is generally "C" shaped.

Figure 5F:
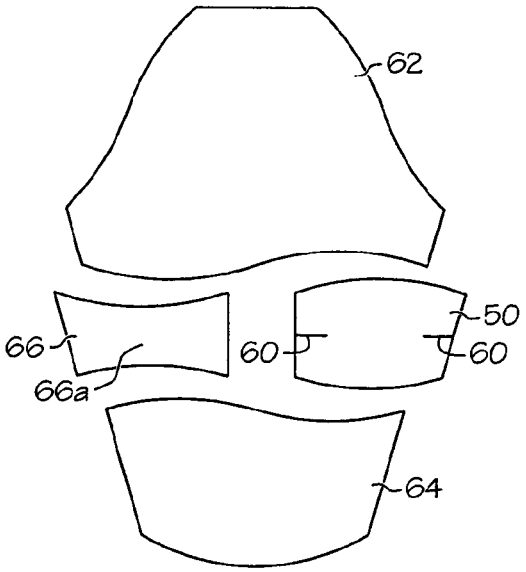

Next, as shown in FIG. 5F, the outer sleeve section/piece of material 50 is positioned (with the folds 52 facing inwardly and thus not visible) between an upper sleeve section 62 and a lower sleeve section 64. The outer sleeve section 50 is also positioned adjacent to an inner sleeve section 66, which is also positioned between the upper sleeve section 62 and lower sleeve section 64. The upper sleeve section 62, lower sleeve section 64 and inner sleeve sections 66 may be generally flat, and may be made of the same material as the outer sleeve section 50 (i.e., the materials of the outer shell 26 when forming a sleeve for the outer shell 26). It may advantageous to make the upper 62, lower 64 and inner sleeve 66 sections from generally flat standard pieces of material and to make a relatively small, short outer sleeve section 50 which contributes curvature to the sleeve 24. In this case the upper 62, lower 64 and outer 66 sections can be easily made by standard manufacturing processes, and do not have any curvature.

Figure 5G:
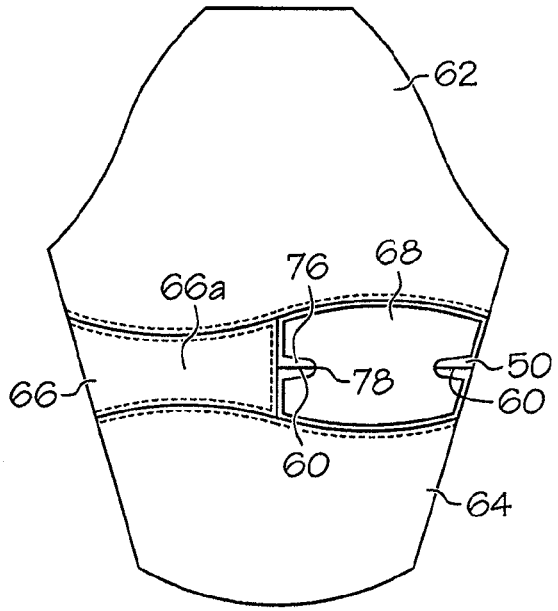

Next, as shown in FIG. 5G, the upper sleeve section 62, inner sleeve section 66, outer sleeve section 50, and lower sleeve section 64 are coupled together, such as by stitching. In addition, in the illustrated embodiment, an elbow pad 68 (which will be described in greater detail below) is located on the outer sleeve section 50.

Figure 5H:
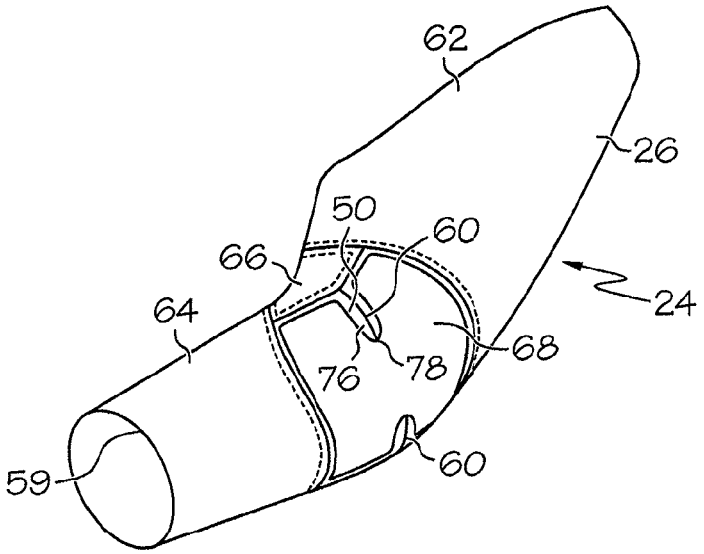

As shown in FIG. 5H, the sleeve section of FIG. 5G is then rolled or formed into a generally cylindrical or generally tubular shape. The adjacent longitudinal edges of the rolled sleeve section are then joined together, such as by stitching, to form a sleeve 24. The sleeve 24 can then be coupled to the body portion 12 of the coat 10. Thus, in one embodiment each sleeve 24 may be constructed from three generally tubular or generally cylindrical sleeve sections, namely an upper section 62, a middle section 50/66 and a lower section 64.

As noted above the dart seams 60 provide a natural curvature to the outer sleeve section 50, and thus to the sleeve 24 as a whole. In addition, the inner sleeve section 66 includes a relatively narrow throat portion **66*a* to also encourage/allow bending of the sleeve 24 without bunching. In addition, rather than using a dart seam 60, curvature may be provided by using a pleat, such as a standard pleat wherein portions of the material are pulled into an overlapping configuration and joined together. In this case the pleat(s) can replace the dart seam(s) and be located at the same location as the dart seams 60 shown herein. For the purposes of this application the term "seam" as used herein is construed to cover the dart seam 60** described herein, as well as a pleat.

The use of a seam to impart the desired curvature to the sleeves 24 provides a relatively easy and efficient method to form the curved sleeve 24. In particular, because no cutting of fabric or material may be required, the use of a seam may provide for ease of manufacture. In addition, the cutting and removal of fabric or material removes material that can provide heat insulation, flame protection etc., and is thus avoided. Stated differently, the fold of material created by the seam provides additional insulation.

The outer sleeve section 50 may be joined to the inner sleeve section 66 to form an elbow section 50/66. The outer portion of each elbow section 50/66 (i.e. extending along the outside of the elbow) may have a length that is at least about ten percent, or at least about twenty percent, or at least about forty percent longer than the inner portion of that elbow section 50/66 (i.e. extending along the inner crux **66*a* of the elbow section). Thus, when the sleeve 24 is assembled as described above, the sleeve 24 has an inner length less than an outer length to provide an outside-in curvature, as more clearly shown in FIG. 3, that conforms to the natural curvature of the wearer's arm. The sleeve 24, at its end or at the cuff 59, may form an angle A of at least about five degrees, or at least about ten degrees, or at least about fifteen degrees with a vertical axis when the sleeve 24** hangs free.

The natural curvature of the sleeves 24 reduces stress upon the user. In particular, when a person is resting, his or her arms typically rest with a slight break at the elbows. Thus the curvature in the sleeves 24 allows the wearer's arms to assume a natural resting position without having to bend the sleeves 24 of the garment 10. In addition, when a user bends his or her arms at the elbow, less work is required to bend the sleeve 24 given that the sleeve 24 is already "pre-bent." In other words, if the sleeves 24 were to be straight and were to be desired to be bent to an angle of forty-five degrees, a force required to bend the sleeves 24 the full forty-five degrees must be exerted. In contrast, if the sleeves 24 are pre-bent to an angle of fifteen degrees, the user only needs to bend the sleeves 24 thirty degrees which imparts less stress upon the wearer. The reduced stress can be significant in repetitive motion activity, particularly given the weight of the garment 10 and other equipment required to be carried by the wearer, as well as the stiffness of the garment 10.

In addition the dart seam 60 and throat portion **66*a* reduce bunching of materials. For example, the remainder portions of the sleeve 52 (i.e., the triangular folds 52**) are positioned internally. Thus the crux of the elbow thus includes less material than a standard sleeve to eliminate material that can be bunched during elbow movement (i.e., when moving a hand towards the shoulder). Because bunching of material is reduced, freer movement and a greater range of motion are provided.

If desired, only one layer of the garment (i.e. the outer shell 26) may have sleeves 24 with a natural curvature (i.e. an outer sleeve portion 26 with dart seams 60). In this case the moisture barrier 28, thermal liner 30, and face cloth 32 may be formed in the standard manner and may lack any curvature and may be flexible enough to be easily bent. However, if desired one, some, or all of the inner layers 28, 30, 32 may also be made to have a natural curvature (i.e. by forming a dart seam therein). In this case all or the selected ones of the inner layers 28, 30, 32 can be formed using the method described above and shown in FIGS. 5A-5H which provides a sleeve 26 with a more defined curvature. Of course, the seams of the various layers 28, 30, 32 may be aligned (i.e. with the elbow of the garment 10 or of the wearer) to provide ease of bending. For example, as shown in FIG. 4, the moisture barrier 28 has a pair of dart seams 60 formed in the same manner outlined above.

The arrangement described above shown for use with a sleeve 26 may also be utilized in the pant leg 44 of a pair of trousers 40, as shown in FIG. 2. Each leg 44 may have leg sections 44*a*, 44*b*, 44*c*, 44*d* in the same manner as the sleeve sections 62, 50, 64, 66 described and shown above. In this manner each leg 44 may have a curvature that conforms to the natural curvature of the wearer's leg, thereby providing the same or similar advantages to those outlined above in the context of the sleeves 26.

The coat 10 and trousers 40 may be provided with pliable protective pads 68 secured to the outer shell 26 on the sleeves 24/legs 44 to reinforce the elbow/knee regions of the coat 10/trousers 40. Additional pads may be provided at other locations on the garments, such as along or adjacent to joints of the wearer such as shoulders, wrists, hips, etc.

Each pad 68 may be made from a relatively durable and generally stiff material. In one embodiment each pad 68 is made of the same material as the outer shell 26. Thus each pad 68 can be made of the same materials as those listed above for the outer shell 26 material such as an aramid material (i.e. in one case a polymer-coated KEVLAR® aramid material), a blend of aramid materials, a polybenzamidazole material, a blend of aramid and polybenzamidazole materials, or other appropriate materials. The pads 68 could also be made of leather or synthetic leather. The pads 68 can be attached to the garment by a variety of methods, such as stitches, adhesives, bonding, sonic welding, heat welding or the like.

Thus, each pad 68 may be made from a durable and fire-resistant material and may have a stiffness sufficient to absorb impacts and abrasions and provide resistance to wear and tear. Each pad 68 may have a thickness of less than about 1 mm, or greater than about 0.1 mm, or between about 0.3 mm and about 0.6 mm. Each pad 68 may have a TPP factor of at least about 3, or at least about 5, or at least about 10. The material of each pad 68 may be able to resist igniting, burning, melting, dripping and/or separation at a temperature of 500° F. for at least five minutes. If desired, each pad 68 may trap a protective layer, such as foam or the like, between the pad 68 and the outer shell 26 to provide further protection and padding.

Figure 7:
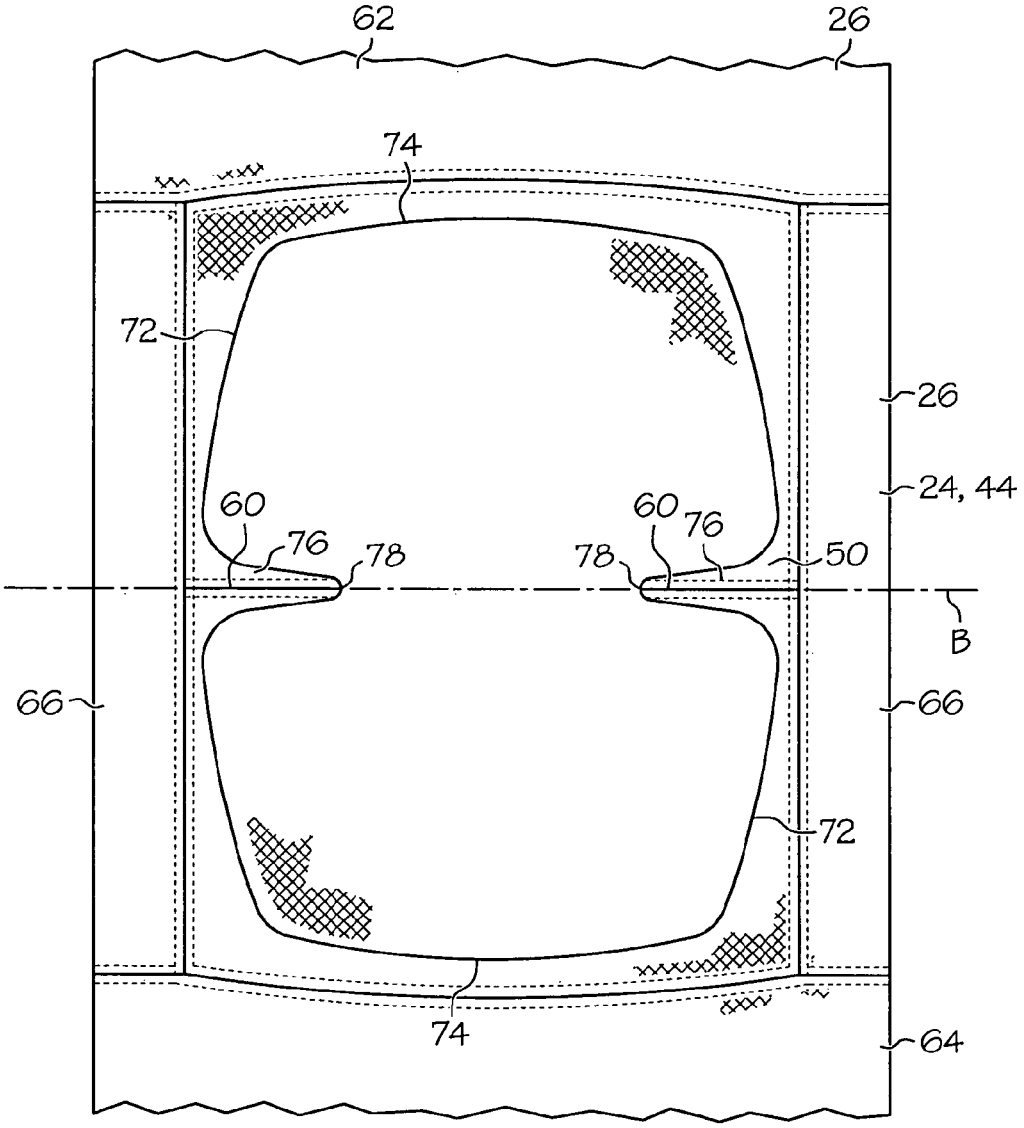
FIG. 7 is a front view of a protective pad of the garment of FIG. 6.

As best shown in FIG. 7, each pad 68 may be generally rectangular in shape (in top view) in which case the pad 68 includes two longitudinal edges 72 and two lateral edges 74 forming an outer perimeter. Each pad 68 may have a length of at least about four inches, or at least about six inches, and a width of at least about four inches, or at least about six inches. Each pad 68 may have a length that is at least about ⅛, or at least about ¼, of the length of an associated extremity (i.e. the length of an associated sleeve 24 or leg 44 of the garment). Besides being rectangular, the pads 68 can have a variety of shapes, including but not limited to square, circular, oval, triangular, hexagonal, trapezoidal, irregular and the like.

Each pad 68 may include a notch or cut-out 76 positioned generally centrally in each longitudinal edge 72. Each notch 76 may be positioned to align with the axis of rotation B or center of pivot (see FIG. 8) of the wearer's joint (such as a knee or elbow) when the garment is worn. Each notch 76 may, for example, be positioned along the length of a sleeve 24 or leg 44 that generally corresponds to the elbow or knee of the garment 10/40, or of a wearer. Each notch 76 may also be aligned with the dart seam 60 if the dart seam 60 is present, which also allows for ease of pivoting at the joint. Thus the dart seam 60 and notches 76 can cooperate to provide improved flexibility and ease of bending.

Figure 8:
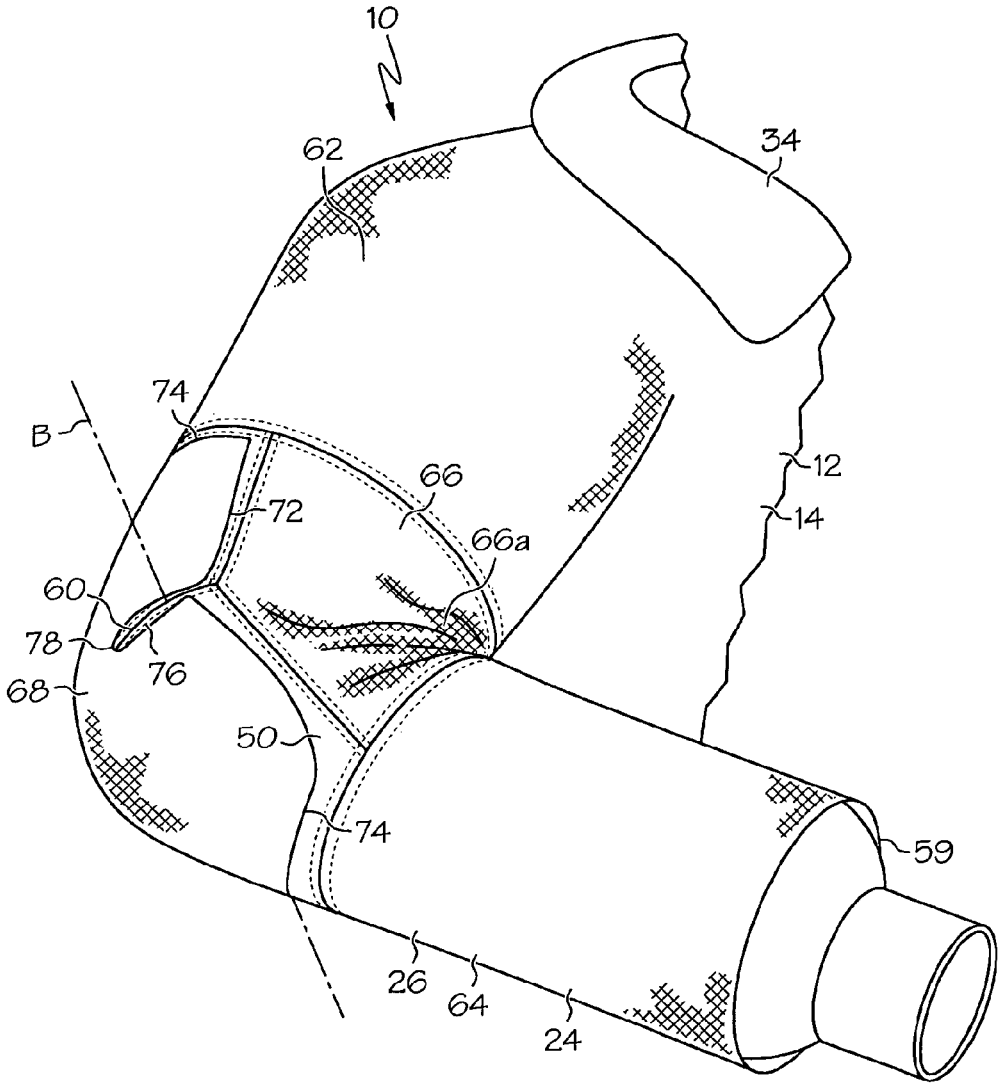
FIG. 8 is a front perspective view of a bent sleeve of the protective garment of FIG. 1.

With reference to FIG. 8, the notches 76 facilitate bending of the garment and pad 68 about the axis formed by the aligned notches 76. In particular, because the notches 76 define an area of the pad 68 having a reduced width, the pad 68 is inherently easier to bend about the axis formed by the aligned notches 76. In addition, the removed areas of the pad 68 provided by the notches 76 help to reduce bunching of the pad 68 when the wearer flexes or bends his or her joint to thereby provide easier flexing, as shown in FIG. 8. By providing the notches 76 in the pad 68, the portion of the pad 68 that would bunch up when the wearer flexes or bends his or her knee or elbow is removed.

In the illustrated embodiment the notches 76 are generally semi-oval or generally "V" shaped in front view. These or other similar shapes may provide certain advantages in that the point or tip 78 of the cut-out 76 provides a distinct point or line of bending for the pad 70. However, the notches 76 can be any of a variety of shapes, including but not limited to triangular, rectangular, square, semicircular, etc. The notches 76 may merely provide an area of removed material and provide an area about which the pad 68 is predisposed to bend, or about which bending of the pad 68 is easier.

In addition, the notches 76 need not necessarily be located on the same position along the longitudinal edges 72 of the pad 68. For example, one notch 76 could be located on an upper portion of the longitudinal edge 72, and the other notch 76 could be located on a lower portion of the other longitudinal edge 72 to define an angled fold guide line. Further, if desired the pad 68 may include only a single notch 76.

Each pad 68 may be located only on the outer sleeve section 50, 44*b* of the associated sleeve 24 or leg 44. This may allow for ease of manufacturing as each pad 68 can be located on the associated outer sleeve section 50, 44*b* before the outer sleeve section 50, 44*b* is coupled to the other sections (as shown in FIG. 5G), which allows increased access and ability to manipulate the outer sleeve section 50, 44*b* while attaching the pad 68. If desired, the outer sleeve section 50, 44*b* may be sized to generally match the height/length of the associated pad 68, or vice versa, to ensure each outer sleeve section 50, 44*b* can fully support a pad 68 thereon.

Figure 9:
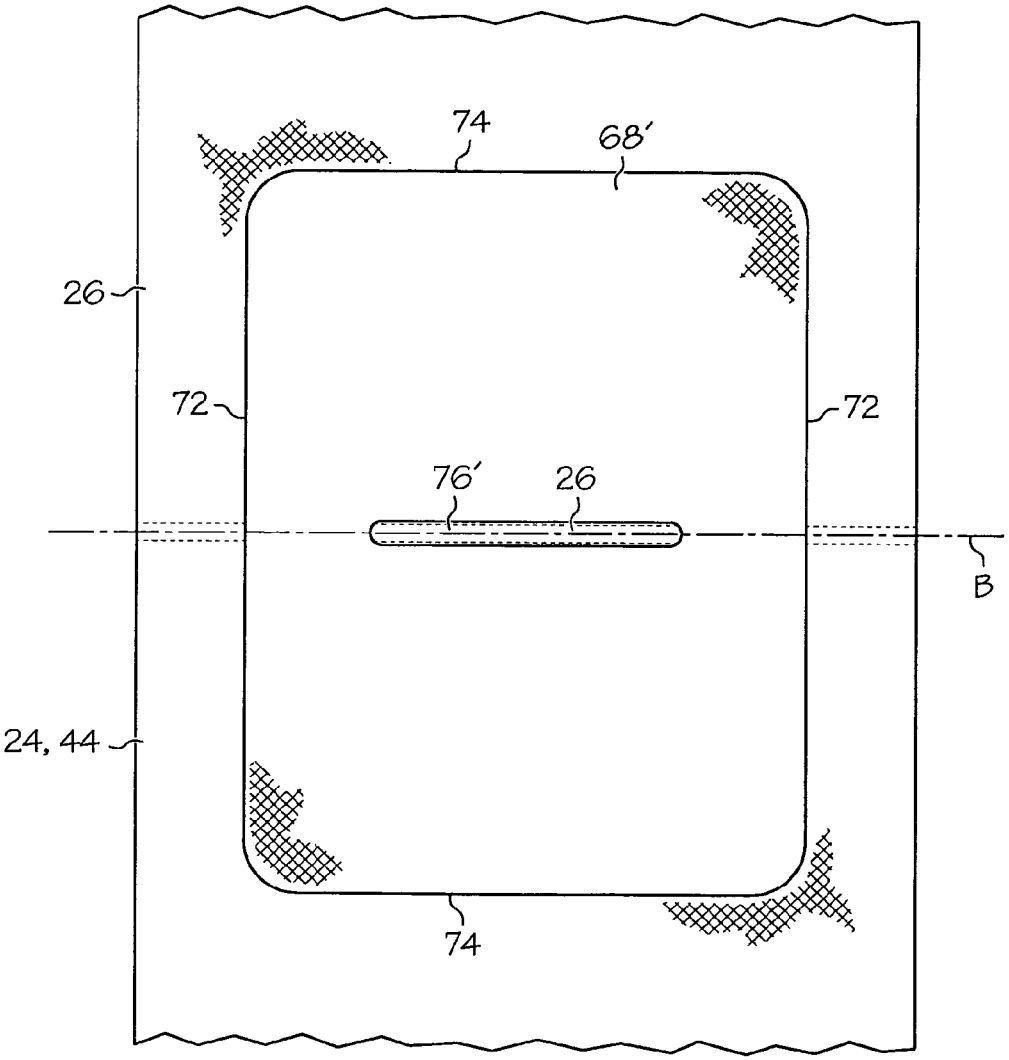
FIG. 9 is a front view of another protective pad located on a garment.

In addition, the pad may have a variety of other shapes or configurations-which allow the pad to bend about the desired axis B. For example, as shown in FIG. 9, in one embodiment the pad 68' includes a central "notch" 76' or area wherein portions of the pad material are removed to expose the outer shell 26 therebelow. The central cut-out 76' also provides an area of weakness upon which the pad 68' is predisposed to bend. In addition, rather than being removed material, the area 76' may instead be an area of weakness (i.e., a thinned portion of the pad material) or the like that extends along the desired axis. Of course, any of a wide variety of other embodiments or methods to provide a pad 68, 68' which is predisposed to bend about a desired axis can be utilized without departing from the scope of the invention.

The ability of the pads 68 to bend reduces stress upon the wearer, in particular during repetitive movement activity. In addition, the ability of the pads 68 to bend easily allows the sleeves 24 and legs 44 to easily assume their nature curvature shape as outlined above.

Referring now to FIG. 10, the protective or hazardous duty garment may take the form of a pair of trousers 40'. As illustrated in FIG. 10, the trousers 40' include a body portion or torso portion 142 that is shaped and configured to receive the pelvis or lower portion of a wearer's torso therein. The torso portion 142 may include a waistband 146. The trousers 40' also include a right leg 144 (shown as side view to reveal an inseam 100) and a left leg 144' (shown as a front perspective view) coupled to and extending generally outwardly or downwardly from the body portion 142. Right and left as used herein are relative to the leg of the wearer that is receivable in the respective leg 144. The right and left legs 144, 144' are generally shaped and configured to receive a wearer's legs therein and may cover at least about 90% of the legs of an average sized adult wearer.

The trousers 40' may have the same construction including the features and/or the materials of the outer shell 26, moisture barrier 28, thermal liner 30 and face cloth 32 as described above and illustrated for the coat 10. In addition, the legs 144, 144' and inseam 100 as described herein may also take the form of a coveralls, jumpsuits, full-body jumpsuits including a coat and trousers combined into a single garment, bib overalls, and the like.

Still referring to FIG. 10, in one embodiment, the trousers 40' include a knee joint area 144*b* in each leg 144, 144', also referred to herein as extremities. Each knee joint area 144*b* is connected to an upper leg portion 144*a* by an upper radial seam 148 and is connected to a lower leg portion 144*c* by a lower radial seam 150. The knee joint area 144*b* includes an inseam insert 104 connected between the upper and lower radial seams 148, 150. The inseam insert 104 provides improved continual alignment of the knee joint area 144*b*, in particular the knee pad 68, during flexing of the knee such as during bending, crawling, and crouching. The inseam insert 104 helps ensure that when the wearer is kneeling or bending, the leg of the garment bends in alignment with the leg so that the knee of the wearer centers on the knee pad of the knee joint area 144*b*. The trousers 40' may also include a crotch strip 102 connecting the legs 144, 144' to provide a seamless crotch. The crotch strip 102 is a continuous strip extending from the upper radial seam 148 of the right leg 144 to the upper radial seam 148 of the left leg 144'. This provides the wearer with the added comfort of a seamless crotch, i.e., eliminates rubbing and chaffing and general discomfort associated with the extra material typically present in a crotch seam. The elimination of the crotch seams reduces tension in the crotch area to give added comfort and helps to alleviate stress to extend the useful life of the garment. FIG. 10 further depicts the inseam insert 104 having an entire length generally parallel to the inseam and having an entire width, the entire length being greater than the entire width.

Figure 11:
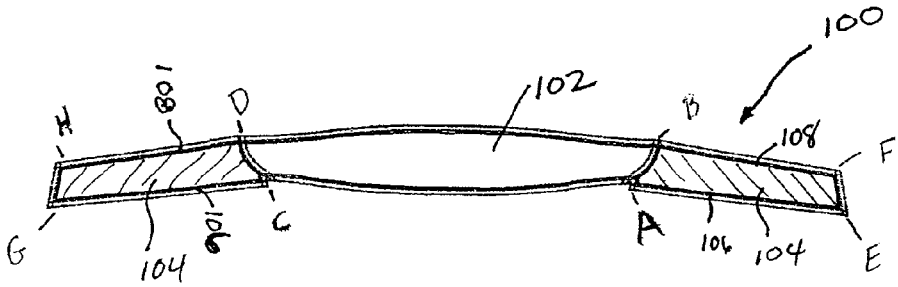
FIG. 11 is an exploded view of the patterns that provide the pieces of material that are ultimately formed into trousers similar to those shown in FIG. 10.
Figure 11:
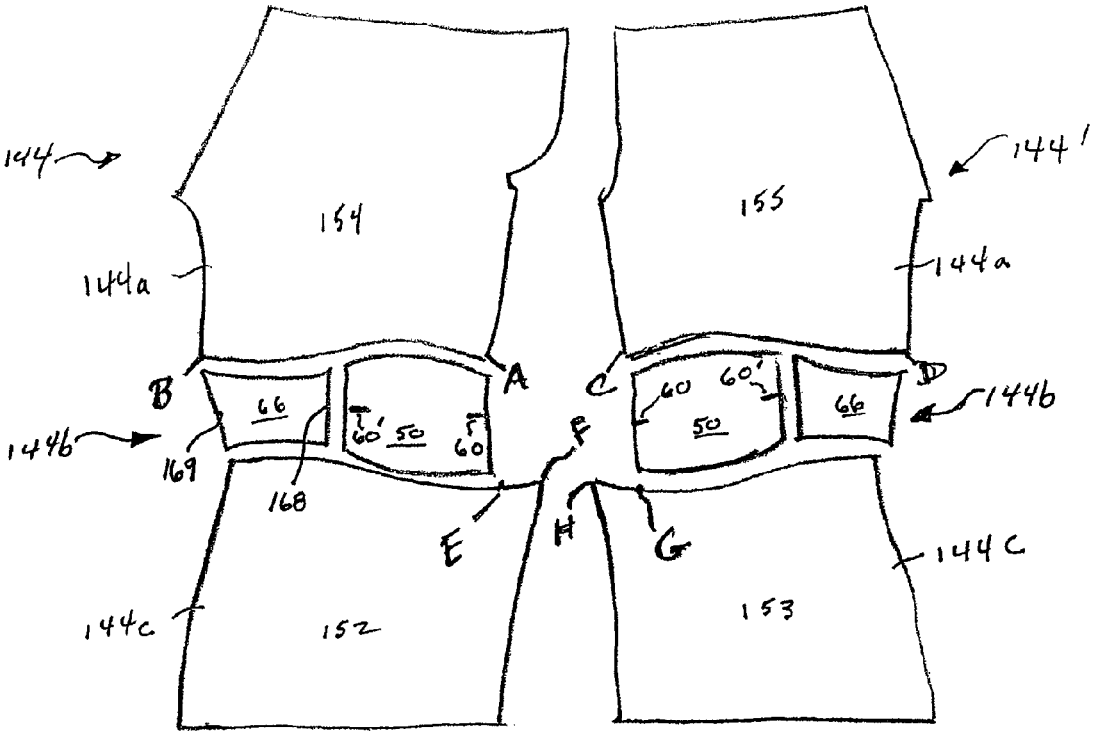

As shown by the pattern pieces in FIG. 11, the knee joint area 144*b* of each leg 144, 144' is constructed of a first piece of material 50 having a feature 60 that attributes a permanent bend to the legs 144, 144' at the knee joint area 144*b* when the legs 144, 144' are fully assembled. In one embodiment, the feature 60 in the first piece of material 50 is a generally triangular-shaped fold 52 (as illustrated in FIGS. 5B-5C) permanently formed in portions of the material. The generally triangular-shaped fold 52 extends generally radially inward into the material from a periphery of the first piece of material 50. Herein, radial is viewed as relative to the first piece of material 50 in its assembled form as a generally tubular portion of the legs 144, 144'. In another embodiment, the feature 60 may be a seam 56 as shown in FIG. 5C that joins together two fold lines 53 shown in FIG. 5B within the first piece of material 50 thereby forming a remainder portion 52 of the material extending away from the seam 56.

Regardless of which feature 60 is present, the periphery of the first piece of material 50 that includes feature 60 is coupled to a side 106 of the inseam insert 104 that extends between the upper and lower radial inseams 148, 150. As shown in FIGS. 10-11, the knee joint area 144*b* also includes a second piece of material 66 connected to the first piece of material 50. The second piece of material 66 has opposing first and second sides 168, 169 as best seen in FIG. 11. The first side 168 may be coupled to the first piece of material 50 opposite where the first piece of material is coupled to side 106 of the inseam insert 104. Then, the second side 169 of the second piece of material 66 is coupled to side 108 of the inseam insert to form a generally tubular shaped knee joint area 144*b* comprising the first piece of material 50 sewn between the second piece of material 66 and the inseam insert 104.

In one embodiment, the first piece of material 50 may include a second feature 60'. The second feature 60' may be positioned opposite the first feature 60 and as such may be included in the portion of the first piece of material 50 that is coupled to the first side 168 of the second piece of material 66. The features 60, 60' individually or together define a joint axis 170 in the knee joint area.

In another embodiment, the knee joint area 144*b* may include a protective pad 68 located on the first piece of material 50 such that the protective pad 68 is predisposed to bend about the joint axis 170. The protective pad 68 may be or include the features as described above including a pair of generally aligned notches 76 formed into opposing edges of the outer periphery of the pad as illustrated in FIGS. 5G, 7, 8, and 10. The notches 76, upon positioning the protective pad 68 on the first piece of materials, should be aligned or positioned along the joint axis 170.

The present invention provides improvements in protective garments by permitting cost-effective manufacturing of a knee joint area 144*b* having an inseam insert 104 that permits greater joint flexibility and protection during joint flexing and compression, while decreasing the effort needed to flex joints when wearing the trousers 40' and providing improved continual alignment of the knee joint area 144*b*, in particular the knee pad 68, during flexing of the joints. An additional benefit to the wearer is the added comfort of a seamless crotch provided by the crotch strip 100.

The trousers 40' result from the combination and seaming of patterns shown in FIG. 11. As shown in FIG. 11, the patterns for the upper and lower leg portions 144*a*, 144*c* and the knee joint area 144*b* for the right and left legs 144, 144' are shown as arranged for assembly. The description which follows, while relating to the right pant leg 144, applies similarly to the construction of the left pant leg 144'. The first piece of material 50 is first modified to include the feature 60 and/or feature 60', such as a seam, as described above for FIGS. 5A-5E. Then, the first piece of material 50 is permanently fixed to the inseam insert 104, for example by a sewn seam, and the opposite side of the first piece of material 50 is permanently fixed to the second piece of material 66, for example by a sewn seam. These connected pieces are then permanently fixed to the upper leg portion 144*a* between points A and B to form the upper radial inseam 148 and then permanently fixed to the lower leg portion 144*c* beginning at point E to form the lower radial inseam 150.

Next, the torso portions 142 of the left and right legs 144, 144' are permanently fixed together at the front seam 180 below the fly area 182, if one is present, as illustrated in FIG. 10. The legs 144, 144' are then rolled and the opposite side edges of the second piece of material 66 and the inseam insert 104 are seamed to form an inseam 184, shown best in FIG. 10, that extends from the upper radial inseam 148 to the cuff 186 of the lower leg portion 144*c*. Inseam 100, in particular, crotch strip 102 connects to the assembled leg portions to complete the right and left legs with a pair of inseams 188. One inseam begins at point A of the upper leg portion 144*a* of the right leg 144 and extends to point C of the upper leg portion 144*a* of left leg 144' and the second inseam begins at point B of the upper leg portion 144*a* of the right leg 144 and extends to point D of the upper leg portion 144*a* of left leg 144'. Points A, B, C, and D of the crotch strip 102 shown on the pattern piece 100 of FIG. 11 respectively mate with points A, B, C, and D of the upper leg portions 144*a*. The trousers 40' are completed when the remaining portion of inseam 100 connects the upper leg portions 144*a* together to complete the cylinder of the right upper leg portions 144*a*, and the end AB of crotch strip 102 further connects to the inseam insert 104 of the right leg 144 and the end CD of the crotch strip 102 further connects to the inseam insert 104 of the left leg 144'.

The inseam 100 may have about a 3 in to about a 5 in wide crotch strip 102 at its widest point and about a 3 in to about a one and a half in wide inseam inserts 104. In another embodiment, the crotch strip 102 and the inseam insert 104 may be wider. For example, the crotch strip 102 may be about a 7 in to about a 5 in wide strip at its widest point and the inseam inserts may be about 3 in to about a 5 in wide. In one embodiment, the inseam inserts 104 may generally gradually taper along the length, in particularly gradually becoming narrower in width toward the lower radial seam 150. The crotch strip 102 may be at its widest in the middle portion thereof and each end of the strip may gradually taper to a narrower width relative to the middle portion as shown in the pattern pieces of FIG. 11.

Figure 12:
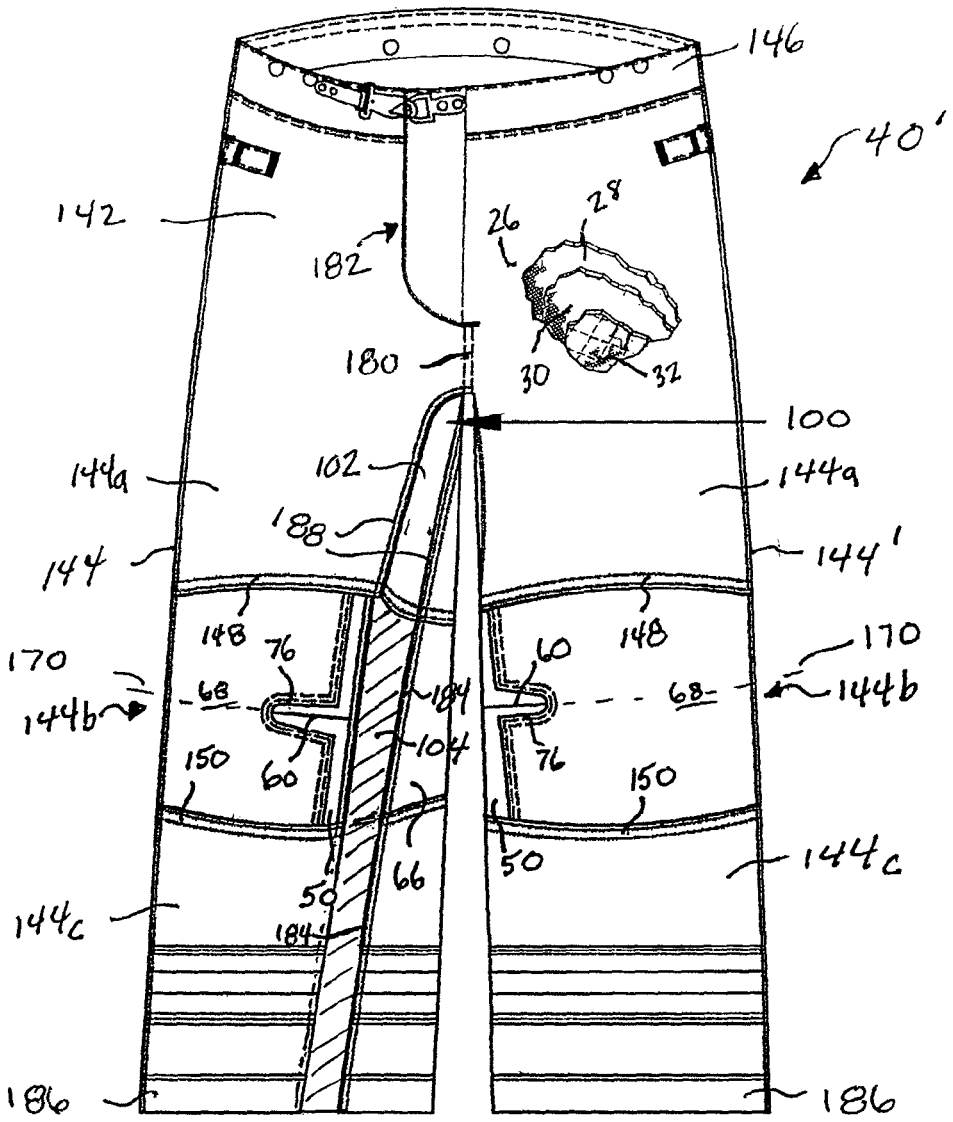
FIG. 12 is a front view of one embodiment of trousers having the right leg shown as a side view to reveal the inseam extending to the cuff of the leg portion.

Referring now to FIG. 12, in another embodiment, the inseam 100, in particular the inseam insert 104, may extend to the bottom cuff 186 of the right and left legs 144, 144'.

In another embodiment, the inseam 100 may include a pie shaped piece or other shapes for the crotch strip 102 and/or the inseam insert 104.

Having described the invention in detail and by reference to preferred embodiments thereof, it will be apparent that modifications and variations are possible without departing from the scope of the invention which is defined in the appended claims.

What is claimed is:

1. A protective garment comprising:

a lower portion having a pair of extremities each comprising a knee joint area connected to an upper leg portion by an upper radial seam and connected to a lower leg portion by a lower radial seam, the knee joint area comprising an inner knee joint section and an outer knee joint section, and a discrete inseam insert connected between the upper and lower radial seams and between the inner knee joint section and the outer knee joint section to form part of an inseam of each of the pair of extremities:

wherein the discrete inseam insert has an entire length generally parallel to the inseam and has an entire width, the entire length being greater than the entire width.

2. The protective garment of claim 1 wherein each knee joint area further comprises a first piece of material defining the outer knee joint section and having a feature to attribute a permanent bend to the extremity at the knee joint area.

3. The protective garment of claim 2 further comprising a crotch strip connecting the pair of extremities to provide a seamless crotch therebetween.

4. The protective garment of claim 3 wherein the crotch strip is continuous from the upper radial seam of one extremity to the upper radial seam of the other extremity.

5. The protective garment of claim 2 wherein the feature in the first piece of material is a generally triangular-shaped fold permanently formed in portions of the material.

6. The protective garment of claim 5 wherein the generally triangular-shaped fold extends generally radially inward into the material from a periphery thereof, and the periphery is coupled to a side of the inseam insert that extends between the upper and lower radial inseams.

7. The protective garment of claim 5 wherein the knee joint area further comprises a second piece of material defining the inner knee joint section, the second piece of material having opposing first and second sides, the first side being coupled to the first piece of material and the second side being coupled to the inseam insert to form a generally tubular shape.

8. The protective garment of claim 2 wherein the feature is a seam that joins together two fold lines within the piece of material thereby forming a remainder portion of the material extending away from the seam.

9. The protective garment of claim 8 wherein the seam extends generally radially inward into the first piece of material from a periphery thereof, and the periphery is coupled to a side of the inseam insert that extends between the upper and lower radial inseams.

10. The protective garment of claim 9 wherein the knee joint area further comprises a second piece of material defining the inner knee joint section, the second piece of material having opposing first and second sides, the first side being coupled to the first piece of material and the second side being coupled to the inseam insert to form a generally tubular shape.

11. The protective garment of claim 2 wherein the feature in the first piece of material defines a joint axis in the knee joint area, and further comprising a protective pad located on the first piece of material and predisposed to bend about the joint axis.

12. The protective garment of claim 11 wherein the protective pad includes an outer perimeter and a pair of generally aligned notches formed in opposing edges thereof, wherein the notches are positioned along the joint axis.

13. The protective garment of claim 1 wherein the lower portion meets National Fire Protection Association 1971 standards for protective firefighting garments.

14. The protective garment of claim 1 wherein the lower portion includes an outer shell that is abrasion, flame and heat resistant.

15. The protective garment of claim 14 wherein said outer shell resists igniting, burning, melting, dripping or separation when exposed to a temperature of 500° F. for five minutes.

16. The garment of claim 14 further comprising a moisture barrier located generally inside of said outer shell such that when said garment is worn said moisture barrier is located generally between said outer shell and a wearer of said garment, said moisture barrier being made of a material that is generally liquid impermeable and generally moisture vapor permeable.

17. The protective garment of claim 16 further comprising a thermal liner located generally inside said outer shell such that when said garment is worn said thermal liner is located generally between said outer shell and a wearer of said garment.

* * * * *